US011001962B2

(12) United States Patent
Liu et al.

(10) Patent No.: US 11,001,962 B2
(45) Date of Patent: May 11, 2021

(54) ELECTRON BEAM CURED SILICONIZED FIBROUS WEBS

(71) Applicant: 3M INNOVATIVE PROPERTIES COMPANY, St. Paul, MN (US)

(72) Inventors: Junkang J. Liu, Woodbury, MN (US); Lang N. Nguyen, St. Paul, MN (US); Karl B. Richter, St. Paul, MN (US); Roy Wong, Grant, MN (US); Panu K. Zoller, River Falls, WI (US)

(73) Assignee: 3M INNOVATIVE PROPERTIES COMPANY, St. Paul, MN (US)

( * ) Notice: Subject to any disclaimer, the term of this patent is extended or adjusted under 35 U.S.C. 154(b) by 0 days.

(21) Appl. No.: 16/254,736

(22) Filed: Jan. 23, 2019

(65) Prior Publication Data

US 2019/0153665 A1 May 23, 2019

Related U.S. Application Data

(62) Division of application No. 13/643,573, filed as application No. PCT/US2011/033021 on Apr. 19, 2011, now Pat. No. 10,202,721.

(60) Provisional application No. 61/329,411, filed on Apr. 29, 2010.

(51) Int. Cl.

| | |
|---|---|
| ***D06M 15/643*** | (2006.01) |
| ***D04H 1/4218*** | (2012.01) |
| ***D04H 1/645*** | (2012.01) |
| ***D04H 1/4382*** | (2012.01) |

(52) U.S. Cl.

CPC ..... *D06M 15/643* (2013.01); *D04H 1/4218* (2013.01); *D04H 1/4382* (2013.01); *D04H 1/645* (2013.01); *Y10T 442/20* (2015.04)

(58) Field of Classification Search

CPC . D06M 15/643; D04H 1/4218; D04H 1/4382; D04H 1/645; Y10T 442/20

See application file for complete search history.

(56) References Cited

U.S. PATENT DOCUMENTS

| | | | |
|---|---|---|---|
| 991,574 | A | 5/1911 | Wesson |
| 2,763,609 | A | 9/1956 | Lewis |
| 2,956,904 | A | 10/1960 | Hendricks |
| 3,146,799 | A | 9/1964 | Frank |
| 4,201,808 | A | 5/1980 | Cully |
| 4,348,454 | A | 9/1982 | Eckberg |
| 4,542,067 | A | 9/1985 | Yamamoto et al. |
| 4,547,431 | A | 10/1985 | Eckberg |

(Continued)

FOREIGN PATENT DOCUMENTS

| | | |
|---|---|---|
| EP | 452034 | 10/1991 |
| EP | 2062952 | 5/2009 |

(Continued)

OTHER PUBLICATIONS

ASTM D 3330M-90 Standard Test Methods for Peel Adhesion of Pressure-Sensitive Tape at 180 Angle [Metric]1, pp. 464-467.

(Continued)

*Primary Examiner* — Robert S Walters, Jr.

(74) *Attorney, Agent, or Firm* — Harold C. Knecht, III

(57) ABSTRACT

Siliconized fibrous webs are described. The siliconized webs include a fibrous web saturated with an electron beam cured silicone composition. Siliconized webs with electron beam cured silicone coating are also described. Methods of preparing both the coated and uncoated siliconized fibrous webs are also described.

13 Claims, 1 Drawing Sheet

(56) References Cited

U.S. PATENT DOCUMENTS

| | | | |
|---|---|---|---|
| 4,549,880 | A | 10/1985 | Hendrix |
| 4,684,670 | A | 8/1987 | Eckberg |
| 4,767,494 | A | 8/1988 | Kobayashi |
| 4,810,728 | A | 3/1989 | Gross |
| 4,859,712 | A | 8/1989 | Cox |
| 4,865,920 | A | 9/1989 | Sweet |
| 4,991,574 | A | 2/1991 | Pocknell |
| 5,147,916 | A | 9/1992 | Sweet |
| 5,162,410 | A | 11/1992 | Sweet |
| 5,248,739 | A | 9/1993 | Schmidt |
| 5,302,671 | A | 4/1994 | Cifuentes |
| 5,356,940 | A | 10/1994 | Giesen |
| 5,436,274 | A | 7/1995 | Sumpter |
| 5,543,231 | A | 8/1996 | Kidon |
| 5,661,192 | A | 8/1997 | Giraud |
| 5,670,555 | A | 9/1997 | Loiselle |
| 5,683,527 | A | 11/1997 | Angell |
| 5,747,172 | A | 5/1998 | Crivello |
| 5,804,610 | A | 9/1998 | Hamer |
| 5,905,123 | A | 5/1999 | Cifuentes |
| 5,907,018 | A | 5/1999 | Mazurek |
| 5,961,770 | A | 10/1999 | Cifuentes |
| 6,051,747 | A | 4/2000 | Lindqvist |
| 6,207,875 | B1 | 3/2001 | Lindqvist |
| 6,359,026 | B1 | 3/2002 | Marquardt |
| 6,406,793 | B1 | 6/2002 | Aoki |
| 6,472,581 | B1 | 10/2002 | Muramatsu |
| 6,545,086 | B1 | 4/2003 | Kosal |
| 6,664,359 | B1 | 12/2003 | Kangas |
| 6,818,673 | B2 | 11/2004 | Ferguson |
| 6,846,508 | B1 | 1/2005 | Colas |
| 6,890,601 | B2 | 5/2005 | Griswold |
| 7,005,475 | B2 | 2/2006 | Griswold |
| 7,311,957 | B2 | 12/2007 | Bargo |
| 7,371,464 | B2 | 5/2008 | Sherman |
| 7,393,879 | B1 | 7/2008 | Kresta |
| 7,407,709 | B2 | 8/2008 | Zhou |
| 8,183,167 | B1 | 5/2012 | Delattre |
| 2001/0037008 | A1 | 11/2001 | Sherman |
| 2002/0013442 | A1 | 1/2002 | Sherman |
| 2005/0113479 | A1 | 5/2005 | Eckberg |
| 2005/0136266 | A1 | 6/2005 | Zhou |
| 2005/0282024 | A1 | 12/2005 | Sherman |
| 2007/0110941 | A1 | 5/2007 | Utesch |
| 2007/0202245 | A1 | 8/2007 | Gantner |
| 2007/0212314 | A1 | 9/2007 | Murphy |
| 2008/0058460 | A1 | 3/2008 | Tonge |
| 2009/0117310 | A1 | 5/2009 | Ellringmann |
| 2010/0310852 | A1 | 12/2010 | Weidinger |
| 2011/0206923 | A1 | 8/2011 | Liu |
| 2011/0206924 | A1 | 8/2011 | Liu |
| 2011/0303120 | A1 | 12/2011 | Zoller |

FOREIGN PATENT DOCUMENTS

| | | |
|---|---|---|
| GB | 805388 | 12/1958 |
| GB | 818987 | 8/1959 |
| GB | 2049485 | 12/1980 |
| JP | S60-98638 | 7/1985 |
| JP | S60-209076 | 10/1985 |
| JP | 62-149308 | 7/1987 |
| JP | S63-045301 | 11/1988 |
| JP | 5169595 | 7/1993 |
| JP | 11140323 | 5/1999 |
| JP | 2966495 | 10/1999 |
| WO | WO 1995-023694 | 9/1995 |
| WO | WO 1996-035458 | 11/1996 |
| WO | WO 1998-023305 | 6/1998 |
| WO | WO 1999-018166 | 4/1999 |
| WO | WO 2002-097003 | 12/2002 |
| WO | WO 2003-010257 | 2/2003 |
| WO | WO 2005-005705 | 1/2005 |
| WO | WO 2005-063890 | 7/2005 |
| WO | WO 2008-027498 | 3/2008 |
| WO | WO 2008-057155 | 5/2008 |
| WO | WO 2009-006247 | 1/2009 |
| WO | WO 2009-076389 | 6/2009 |
| WO | WO 2010-056544 | 5/2010 |
| WO | WO 2010-056546 | 5/2010 |

OTHER PUBLICATIONS

ASTM E 1818-960$^{\epsilon 1}$, Standard Practice for Dosimetry in an Electron Beam Facility for Radiation Processing at Energies Between 80 and 300 keV$^{1}$, 1996, pp. 903-910.

Frounchi,"Comparison Between Electron-beam and Chemical Crosslinking of Silicone Rubber", Nuclear Instruments and Methods in Physics Research B, 2006, vol. 243, pp. 354-358.

Labouriau, "Mössbauer, NMR and ATR-FTIR spectroscopic investigation of degradation in RTV siloxane foams," Polym. Degradation & Stability, 2007, vol. 92, pp. 414 -424.

Lin, "Recent advances in silicone pressure-sensitive adhesives," J. Adhesion Sci. Technol., Feb. 2007,vol. 21, No. 7, pp. 605-623.

Park, "Mechanical Properties and Antibacterial Activity of Peroxide-Cured Silicone Rubber Foams," J. Appl. Polym. Sci, May 2008, vol. 110, pp. 1723-1729.

Bajaj "Finishing of Textile Materials" Journal of Applied Polymer Science, vol. 83, 631-659 (2002).

International Search Report for PCT/US2009/062563, dated Feb. 12, 2010, 3 pages.

International Search Report for PCT/US2009/062576, dated Feb. 9, 2010, 4 pages.

International Search Report for PCT/US2009/062608, dated Feb. 8, 2010, 3 pages.

International Search Report for PCT/US2011/033021, dated Jul. 11, 2011, 3 page.

International Search Report for PCT/US2009/062603, dated Feb. 9, 2010, 3 pages.

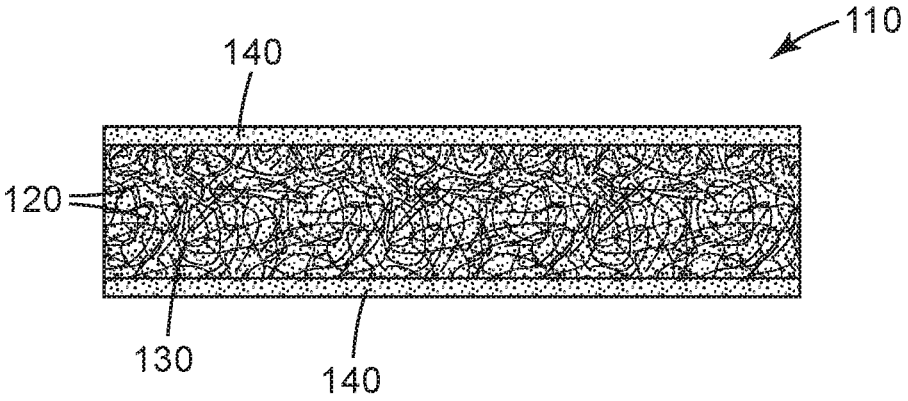
110
140
120
130
140

ELECTRON BEAM CURED SILICONIZED FIBROUS WEBS

FIELD

The present disclosure relates to fibrous webs saturated with electron beam cured silicone materials and methods of preparing such webs.

SUMMARY

Briefly, in one aspect, the present disclosure provides methods of making a siliconized web. These methods include saturating a fibrous web with a first composition comprising one or more polysiloxane materials to form a saturated web and electron beam curing the first composition to crosslink the polysiloxane materials to form a cured, saturated web. In some embodiments, the methods include coating the cured, saturated web with a second composition comprising one or more polysiloxane materials and electron beam curing the second composition to crosslink the polysiloxane materials to form a cured, saturated and coated web. In some embodiments, the methods include coating the saturated web with a second composition comprising one or more polysiloxane materials and electron beam curing the first composition and the second composition to crosslink the polysiloxane materials to form a cured, saturated and coated web.

In another aspect, the present disclosure provides siliconized webs comprising a web saturated with an electron beam cured first composition comprising crosslinked polysiloxane materials. In some embodiments, the siliconized webs also include an electron beam cured second composition comprising crosslinked polysiloxane materials on one or both major surfaces of the siliconized web.

In some embodiments, the polysiloxane materials of one or both compositions are selected from the group consisting of nonfunctional polysiloxanes, silanol terminated polysiloxanes, and alkoxy terminated polysiloxane. In some embodiments, the polysiloxane material of one or both compositions comprises a poly dimethylsiloxane. In some embodiments, all the polysiloxane materials in one or both compositions are nonfunctional polysiloxanes. In some embodiments, one or both compositions are substantially free of catalysts and initiators. In some embodiments, one or both compositions comprise no greater than 5 wt. % solvent.

In some embodiments, the web comprises at least one of fiberglass, polyamide, polyester, polyurethane, cotton, and metal. In some embodiments, the web is a woven fabric, a non-woven fabric, or a knit fabric.

The above summary of the present disclosure is not intended to describe each embodiment of the present invention. The details of one or more embodiments of the invention are also set forth in the description below. Other features, objects, and advantages of the invention will be apparent from the description and from the claims.

BRIEF DESCRIPTION OF THE DRAWINGS

FIG. 1 illustrates an exemplary siliconized web according to some embodiments of the present disclosure.

DETAILED DESCRIPTION

Fibrous webs are often coated for use in applications where the porosity of the web needs to be reduced or eliminated to obtain desirable water-tight and/or air-tight performance. Silicone coatings are often chosen over organic materials because of the unique combination of properties silicone provides, e.g. thermal stability, chemical resistance, fire resistance, UV resistance, and water-proofing.

Siliconized fibrous webs, e.g., woven and non-woven fabrics, are used in a wide variety of applications. Exemplary applications include non-stick belts and sleeves, waterproof articles including tarpaulins, welding blankets, baking mats, and inflatable boats, and automotive applications such as materials for use in airbags, convertible tops, and trunk covers. Additional applications include hot air balloons, sail cloths, tents, awnings, and construction forms.

Current processes used to prepare siliconized webs typically use solvent based silicones that are thermally-cured. The current processes often require the use of large amounts of solvent to provide the desired viscosity for saturating the web. In addition, the processes are often slow as multiple coating/saturating, drying, and thermal curing steps may be required.

The fibrous webs suitable for the present disclosure can be made from any known material. Exemplary materials include polymeric materials (e.g., polyesters, polyurethanes, polyamides, polyimides, and polyolefins), organic fibers (cotton, wool, hemp, and flax); and inorganic fibers (e.g., fiberglass, ceramic, and metal). Fibrous webs come in many forms including, e.g., woven webs, non-woven webs, knits, scrims, and meshes.

Conventional silicone materials are cured by thermal processes using specific types of catalysts. For example, platinum catalysts have been used with addition cure systems, peroxides (e.g., benzoyl peroxide) have been used with hydrogen-abstraction cure systems, and tin catalysts have been used with moisture/condensation cure systems.

Generally, these approaches require reactive functional groups attached to the siloxane backbone. For example, addition-cure, platinum-catalyzed systems generally rely on a hydrosilation reaction between silicon-bonded vinyl functional groups and silicon-bonded hydrogen. In view of costs and other issues, it may be desirable to use materials that do not require specific functional groups for proper curing. It can also be useful to have silicone systems that can be cured without the use of catalysts and/or initiators.

UV-cured and electron-beam cured silicone materials are known. These systems typically require the use of catalysts and specific functional groups. In particular, acrylate-functional and epoxy-functional silicones have been radiation cured in the presence of catalysts.

The present inventors have discovered new methods for producing siliconized webs. Generally, the methods include electron beam curing silicone materials to form a crosslinked polysiloxane network. Generally, the methods can be used with non-functional silicone materials. Functional silicone materials may also be used; however, as the specific functional groups are not typically involved in the crosslinking, the nature and presence of these functional groups is not critical.

In contrast to previous methods for curing silicone materials, the methods of the present disclosure do not require the use of catalysts or initiators. Thus, the methods of the present disclosure can be used to cure compositions that are "substantially free" of such catalysts or initiators. As used herein, a composition is "substantially free of catalysts and initiators" if the composition does not include an "effective amount" of a catalyst or initiator. As is well understood, an "effective amount" of a catalyst or initiator depends on a variety of factors including the type of catalyst or initiator, the composition of the curable material, and the curing method (e.g., thermal cure, UV-cure, and the like). In some embodiments, a particular catalyst or initiator is not present at an "effective amount" if the amount of catalyst or initiator does not reduce the cure time of the composition by at least 10% relative to the cure time for same composition at the same curing conditions, absent that catalyst or initiator.

Generally, the silicone materials useful in the present disclosure are polysiloxanes, i.e., materials comprising a polysiloxane backbone. In some embodiments, the nonfunctionalized silicone materials can be a linear material described by the following formula illustrating a siloxane backbone with aliphatic and/or aromatic substituents:

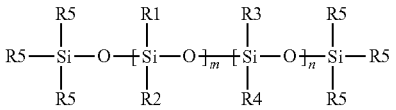

(1)

wherein R1, R2, R3, and R4 are independently selected from the group consisting of an alkyl group and an aryl group, each R5 is an alkyl group and n and m are integers, and at least one of m or n is not zero. In some embodiments, one or more of the alkyl or aryl groups may contain a halogen substituent, e.g., fluorine. For example, in some embodiments, one or more of the alkyl groups may be $—CH_2CH_2C_4F_9$.

In some embodiments, R5 is a methyl group, i.e., the nonfunctionalized polysiloxane material is terminated by trimethylsiloxy groups. In some embodiments, R1 and R2 are alkyl groups and n is zero, i.e., the material is a poly(dialkylsiloxane). In some embodiments, the alkyl group is a methyl group, i.e., poly(dimethylsiloxane) ("PDMS"). In some embodiments, R1 is an alkyl group, R2 is an aryl group, and n is zero, i.e., the material is a poly(alkylarylsiloxane). In some embodiments, R1 is methyl group and R2 is a phenyl group, i.e., the material is poly (methylphenylsiloxane). In some embodiments, R1 and R2 are alkyl groups and R3 and R4 are aryl groups, i.e., the material is a poly(dialkyldiarylsiloxane). In some embodiments, R1 and R2 are methyl groups, and R3 and R4 are phenyl groups, i.e., the material is poly(dimethyldiphenylsiloxane).

In some embodiments, the nonfunctionalized polysiloxane materials may be branched. For example, one or more of the R1, R2, R3, and/or R4 groups may be a linear or branched siloxane with alkyl or aryl (including halogenated alkyl or aryl) substituents and terminal R5 groups.

As used herein, "nonfunctional groups" are either alkyl or aryl groups consisting of carbon, hydrogen, and in some embodiments, halogen (e.g., fluorine) atoms. As used herein, a "nonfunctionalized polysiloxane material" is one in which the R1, R2, R3, R4, and R5 groups are nonfunctional groups.

Generally, functional silicone systems include specific reactive groups attached to the polysiloxane backbone of the starting material (for example, hydroxyl and alkoxy groups). As used herein, a "functionalized polysiloxane material" is one in which at least one of the R-groups of Formula 2 is a functional group.

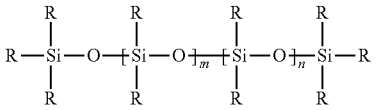

(2)

In some embodiments, a functional polysiloxane material is one is which at least 2 of the R-groups are functional groups. Generally, the R-groups of Formula 2 may be independently selected. In some embodiments, all functional groups are hydroxy groups and/or alkoxy groups. In some embodiments, the functional polysiloxane is a silanol terminated polysiloxane, e.g., a silanol terminated poly dimethylsiloxane. In some embodiments, the functional silicone is an alkoxy terminated poly dimethyl siloxane, e.g., trimethyl siloxy terminated poly dimethyl siloxane.

In addition to functional R-groups, the R-groups may be nonfunctional groups, e.g., alkyl or aryl groups, including halogenated (e.g., fluorinated) alky and aryl groups. In some embodiments, the functionalized polysiloxane materials may be branched. For example, one or more of the R groups may be a linear or branched siloxane with functional and/or non-functional substituents.

Generally, the silicone materials may be oils, fluids, gums, elastomers, or resins, e.g., friable solid resins. Generally, lower molecular weight, lower viscosity materials are referred to as fluids or oils, while higher molecular weight, higher viscosity materials are referred to as gums; however, there is no sharp distinction between these terms. Elastomers and resins have even higher molecular weights that gums, and typically do not flow. As used herein, the terms "fluid" and "oil" refer to materials having a dynamic viscosity at 25° C. of no greater than 1,000,000 mPa·sec (e.g., less than 600,000 mPa·sec), while materials having a dynamic viscosity at 25° C. of greater than 1,000,000 mPa·sec (e.g., at least 10,000,000 mPa·sec) are referred to as "gums".

In order to obtain the viscosity generally desirable for saturating webs, it may be necessary to dilute high molecular weight materials with solvents in order to coat or otherwise apply them to a substrate. However, in some embodiments, solventless systems may be preferable. In some embodiments, the composition comprises less than 5 wt. %, e.g., less than 2 wt. %, e.g., less than 1 wt. % solvent.

To avoid the use of solvents, in some embodiments, it may be preferable to use low molecular weight silicone oils or fluids, including those having a dynamic viscosity at 25° C. of no greater than 200,000 mPa·sec, no greater than 100,000 mPa·sec, or even no greater than 50,000 mPa·sec. In some embodiments, higher viscosity materials may be used and the viscosity during the saturation may be reduced by heating the silicone materials.

The viscosity of silicone material required to facilitate saturation of the web depends on the open area of the web. More viscous materials can be used with looser weaves and lower thread count webs. Tighter weaves and higher thread count webs may require lower viscosities. In some embodiments, the silicone materials have a kinematic viscosity at 25° C. of no greater than 250,000 centistokes (cSt), e.g., no greater than 100,000 cSt, or even no greater than 50,000 cSt. In some embodiments, it may be desirable to use a combination of silicone materials, wherein at least one of the silicone materials has a kinematic viscosity at 25° C. of at least 5,000 centistokes (cSt), e.g., at least 10,000 cSt, or even at least 15,000 cSt. In some embodiments, it may be desirable to use silicone materials having a kinematic viscosity at 25° C. of between 1000 and 50,000 cSt, e.g., between 5,000 and 50,000 cSt, or even between 10,000 and 50,000 cSt.

Generally, any known additives may be included in the silicone composition. Generally, the additives should be selected to avoid interfering with the curing process. In some embodiments, size of the additives, e.g., filler, should be selected to avoid being filtered out during the saturation step.

EXAMPLES

Example 1. Siliconization of Fiberglass in Air

A piece of fiberglass fabric (glass fabric from BGF Industries, Inc., Greensboro, N.C., warp: 39 thread count per cm (100 per inch), fill: 14 thread count per centimeter (36 per inch), thickness: 140 microns (0.0055 inch)) was sandwiched between two layers of PET release liner (2 CL PET5100/5100 from Loparex North America, Hammond, Wis.) and coated with a silanol-terminated polydimethyl siloxane fluid (XIAMETER OHX-4040, 50,000 cP, from Dow Corning). The sandwiched sample was pressed to saturate the silicone fluid throughout the fiberglass between the two sheets of liner. This construction was then exposed to electron beam irradiation at 300 keV and 20 Mrad according to the E-Beam Curing Procedure.

E-Beam Curing Procedure.

E-beam curing was performed on a Model CB-300 electron beam generating apparatus (available from Energy Sciences, Inc. (Wilmington, Mass.)). Generally, a support film (e.g., polyester terephthalate support film) was run through the inerted chamber of the apparatus (<50 ppm oxygen). Samples of uncured material were attached to the support film and conveyed at a fixed speed of about 4.9 meters/min (16 feet/min) through the inerted chamber and exposed to electron beam irradiation. To obtain a total e-beam dosage of 16 Mrad, a single pass through the apparatus was sufficient. To obtain a total e-beam dosage of 20 MRad, two passes through the apparatus were required.

After exposure to the electron beam irradiation, the PET release liners were removed. The silicone did not appear significantly crosslinked as it could be smudged and was tacky.

Example 2. Siliconization of Fiberglass in Nitrogen

A sample was prepared using the materials and procedures of Example 1, except the fiberglass was coated with the silicone material in a nitrogen-inerted glove box. The oxygen content in the glove box was reduced to between 100 and 500 ppm. Upon removal of the liners, both surfaces of the coated fiberglass were smudge-free and tack-free. The surfaces had the same rubbery feel as typical siliconized commercial fiberglass belts.

Cross-sections of the fiberglass web were examined under a microscope before and after siliconization. The images revealed that the silicone material had saturated the full cross-section of the web. In addition each fiberglass thread is composed of a bundle of individual fibers or filaments. Microscopic analysis also revealed that each thread was saturated by cured silicone, binding together the individual fibers or filaments within that thread.

Example 3. Siliconization of Nylon Fabric in Nitrogen

A sample was prepared using the materials and procedures of Example 2, except a commercially available nylon fabric (cornflower matte tulle obtained from Jo-Ann Fabric and Craft Stores (UPC 4000075511041) was used as the fibrous web in place of the fiberglass. Upon removal of the liners, both surfaces of the coated nylon fabric were smudge-free and tack-free. The surfaces had the same rubbery feel as typical siliconized commercial fiberglass belts. Microscopic analysis revealed that cured silicone coated the individual fibers and the spaces between the fibers throughout the cross-section of the fabric.

Example 4. Siliconization of Polyester Knit Fabric in Nitrogen

A sample was prepared using the materials and procedures of Example 2, except a commercially available polyester knit fabric (white dull organza from Jo-Ann Fabric and Craft Stores (UPC 400097489632) was used as the fibrous web in place of the fiberglass. Upon removal of the liners, both surfaces of the coated polyester knit fabric were smudge-free and tack-free. The surfaces had the same rubbery feel as typical siliconized commercial fiberglass belts. Microscopic analysis revealed that cured silicone coated the individual fibers and the spaces between the fibers throughout the cross-section of the fabric.

Example 5. Siliconization of a Woven Glass Fabric

A woven glass fabric (BGF style 2116, untreated, plain weave, warp ECE 225 1/0, fill ECE 225 1/0, thickness: 100 microns (0.0039 inches); available from BGF Industries, Greensboro, N.C.) that had been coated with 2630 white silicone rubber (Dow Corning) was used as the substrate. This substrate was knife coated by hand with a silanol-terminated polydimethyl siloxane (DMS-S42, 18,000 cSt, from Gelest). This construction was then exposed to electron beam irradiation at 300 kev and 16 Mrad according to the E-Beam Curing Procedure.

The resulting, cured siliconized web was evaluated as a silicone belt.

Peel Test Procedure.

A roll of double-coated acrylic foam tape (Acrylic Plus Tape EX4011, available from 3M Company, St. Paul, Minn.) was unwound, exposing the adhesive of the unlinered side. A 2.5 cm strip of the tape was adhered by this adhesive layer to a panel. The liner was then removed exposing the adhesive layer of the linered side. A piece of the siliconized belt of Example 5 was applied to the exposed adhesive layer of the foam tape and rolled down by hand. The construction was aged under the conditions summarized in Table 1. Following each aging step, the siliconized belt was removed from the tape at a 90 degree angle and 30 cm/minute (12 inches per minute) using a tensile tester (obtained from Instron, Norwood, Mass.) and the average peel force was recorded. The same belt was then reapplied to a fresh tape sample, aged, and tested again.

For comparison, this same procedure was conducted using a comparable siliconized belt prepared with a conventional thermally-cured, addition cure silicone. The results are summarized in Table 1. Aging condition "1 min" refers to aging for one minute at room temperature. Aging condition "5 min" refers to aging for five minutes at room temperature (23° C.). Aging condition "7 d/70° C." refers to heat aging for seven days at 70° C., followed by a dwell at room temperature for two to four hours prior to testing.

TABLE 1

| Aging results on 90° peel. | | | |
|---|---|---|---|
| Peel | Aging | Peel force (grams/2.54 cm) | |
| Cycle | Conditions | Example 5 | Comparative |
| 1 | 5 min | 27.4 | 26.3 |
| 2-21 (*) | 1 min | N.A. | N.A. |
| 22 | 5 min | 32.2 | 29.0 |
| 23 | 7 d/70° C. | 58.9 | 64.4 |
| 24 | 5 min | 45.8 | 33.6 |
| 25 | 7 d/70° C. | 67.7 | 70.8 |
| 26 | 5 min | 34.2 | 38.9 |
| 27 | 7 d/70° C. | 63.1 | 67.8 |
| 28 | 5 min | 51.4 | 64.8 |
| 29 | 7 d/70° C. | 51.9 | 49.1 |
| 30 | 5 min | 31.6 | 21.2 |

(*) 20 cycles with one minute dwell per cycle. Sample removed by hand thus, the peel force was not available ("N.A.").

An exemplary saturated web according to some embodiments of the present disclosure is illustrated in FIG. 1. Saturated web 110 comprises web 130 saturated with e-beam cured silicone material 120. In some embodiments, one or both major surfaces of web 130 may coated with the same or a different cured silicone material, 140.

Various modifications and alterations of this invention will become apparent to those skilled in the art without departing from the scope and spirit of this invention.

What is claimed is:

1. A siliconized web comprising a fibrous web saturated with a cured first composition, the first composition comprising one or more polysiloxane materials selected from the group consisting of silanol terminated polysiloxanes, cured to form a cured saturated fibrous web; and a cured second composition, the second composition comprising one or more polysiloxane materials in the form of a coating on the cured saturated fibrous web, cured to form a cured, saturated and coated web, wherein the one or more polysiloxane materials of the first composition and the second composition have been separately electron beam cured so as to crosslink the one or more polysiloxane materials of the first composition and then crosslink the one or more polysiloxane materials of the second composition to thereby form the cured, saturated and coated web.

2. The siliconized web of claim 1, wherein the one or more polysiloxane materials in the first composition comprise a polydimethylsiloxane.

3. The siliconized web according to claim 1, wherein the first composition is substantially free of catalysts and initiators.

4. The siliconized web according to claim 1, wherein the first composition comprises no greater than 5 wt. % solvent.

5. The siliconized web of claim 1, wherein the one or more polysiloxane materials in the second composition are selected from the group consisting of nonfunctional polysiloxanes, silanol terminated polysiloxanes, and alkoxy terminated polysiloxanes.

6. The siliconized web according to claim 1, wherein the one or more polysiloxane materials in the second composition comprise silanol terminated polysiloxanes.

7. The siliconized web of claim 1, wherein the one or more polysiloxane materials in the second composition comprise a polydimethylsiloxane.

8. The siliconized web according to claim 1, wherein the second composition is substantially free of catalysts and initiators.

9. The siliconized web according to claim 1, wherein the second composition comprises no greater than 5 wt. % solvent.

10. The siliconized web according to claim 1, wherein the fibrous web comprises at least one of fiberglass, ceramic fiber and metal fiber.

11. The siliconized web according to claim 1, wherein the fibrous web comprises at least one of polyimide fibers, polyamide fiber, polyester fiber, polyurethane fiber, wool fiber, hemp fiber, flax fiber, and cotton fiber.

12. The web according to claim 1, wherein the fibrous web comprises at least one of a woven fabric, a non-woven fabric, a knit fabric, a scrim and a mesh.

13. The siliconized web of claim 1, wherein the one or more polysiloxane materials of the first composition and the second composition have a siloxane backbone and do not have reactive functional groups attached to its siloxane backbone.

* * * * *